US007055358B1

(12) United States Patent
Meis

(10) Patent No.: US 7,055,358 B1
(45) Date of Patent: Jun. 6, 2006

(54) RADIUS PULL CLAMP

(76) Inventor: William J. Meis, 23590 Old Lincoln Hwy., Crescent, IA (US) 51526

( * ) Notice: Subject to any disclaimer, the term of this patent is extended or adjusted under 35 U.S.C. 154(b) by 56 days.

(21) Appl. No.: 10/864,852

(22) Filed: Jun. 9, 2004

(51) Int. Cl.
*B21D 5/04* (2006.01)

(52) U.S. Cl. ..... 72/308; 72/457; 72/705

(58) Field of Classification Search ..... 72/308, 72/422, 457, 705; 254/113 R
See application file for complete search history.

(56) References Cited

U.S. PATENT DOCUMENTS

| | | | | |
|---|---|---|---|---|
| 3,338,086 | A * | 8/1967 | Hunter | 72/457 |
| 3,610,022 | A * | 10/1971 | Lincourt | 72/457 |
| 4,106,325 | A * | 8/1978 | Kuhn | 72/457 |
| 4,718,266 | A * | 1/1988 | Jarman et al. | 72/422 |
| 6,453,715 | B1 * | 9/2002 | Venalainen | 72/308 |

* cited by examiner

*Primary Examiner*—Ed Tolan
(74) *Attorney, Agent, or Firm*—Thomte, Mazour & Niebergall; Dennis L. Thomte

(57) ABSTRACT

A radius pull clamp for use in pulling vehicle door frames to straighten the same comprising first and second clamp plates which are clamped onto the door frame to assist in the straightening of the same.

7 Claims, 5 Drawing Sheets

RADIUS PULL CLAMP

BACKGROUND OF THE INVENTION

1. Field of the Invention

This invention relates to a radius pull clamp and more particularly to a radius pull clamp for use in pulling vehicle door frames to straighten the same.

2. Description of the Related Art

Frame racks and pulling devices are used to straighten the frames and bodies of wrecked or damaged vehicles. U.S. Pat. No. 6,098,445 illustrates a vehicle holding system used in frame straightening operations. If a door frame of the vehicle is damaged, it is extremely difficult to use the existing equipment to straighten the door frame since it is difficult to attach any type of clamp or hook to the door frames which is made even more difficult due to the fact that the door frames usually have a plurality of radiuses such as illustrated in FIG. 1 of the patent drawings.

SUMMARY OF THE INVENTION

A radius pull clamp is described for use in pulling vehicle door frames to straighten the same. The radius pull clamp of this invention comprises first and second flat clamp plates which have inner and outer sides and a periphery. The first and second clamp plates are mirror images of one another and are adapted to be closely positioned together in a superposed relationship. Each of the clamp plates has spaced-apart bolt openings formed therein which register with the bolt openings in the other clamp plate. Bolt members extend through at least some of the registering bolt openings to hold the clamp plates closely adjacent one another. A pull bracket is secured to the pull clamp by means of a bolt member extending through registering bolt openings and through the pull bracket. Each of the clamp plates has a plurality of different radiuses formed in the periphery thereof as well as a straight peripheral portion. The inner side of the first plate has a plurality of spaced-apart teeth formed therein inwardly of the periphery thereof which extend towards the second plate. The inner side of the second clamp plate has a plurality of spaced-apart recesses formed therein inwardly of the periphery thereof which register with the teeth on the first clamp plate.

The pull clamp is clamped on the inwardly projecting lip of the door frame at the desired location with the pull clamp being positioned with respect thereto so that the proper radius is clamped onto the lip of the door frame. A pull chain is connected to the pull bracket and pulling force is applied to the pull clamp to straighten the door frame. The heat-treated teeth provide a non-slip hold on the door frame.

It is therefore a principal object of the invention to provide a radius pull clamp for use in pulling vehicle door frames to straighten the same.

A further object of the invention is to provide a radius pull clamp comprised of first and second flat clamp plates having a plurality of radiuses formed in the periphery thereof as well as a straight peripheral portion.

Yet another object of the invention is to provide a radius pull clamp of the type described including means for gripping the door frame.

Still another object of the invention is to provide a radius pull clamp of the type described which is easy to use.

These and other objects will be obvious to those skilled in the art.

DESCRIPTION OF THE PREFERRED EMBODIMENT

Figure 1:
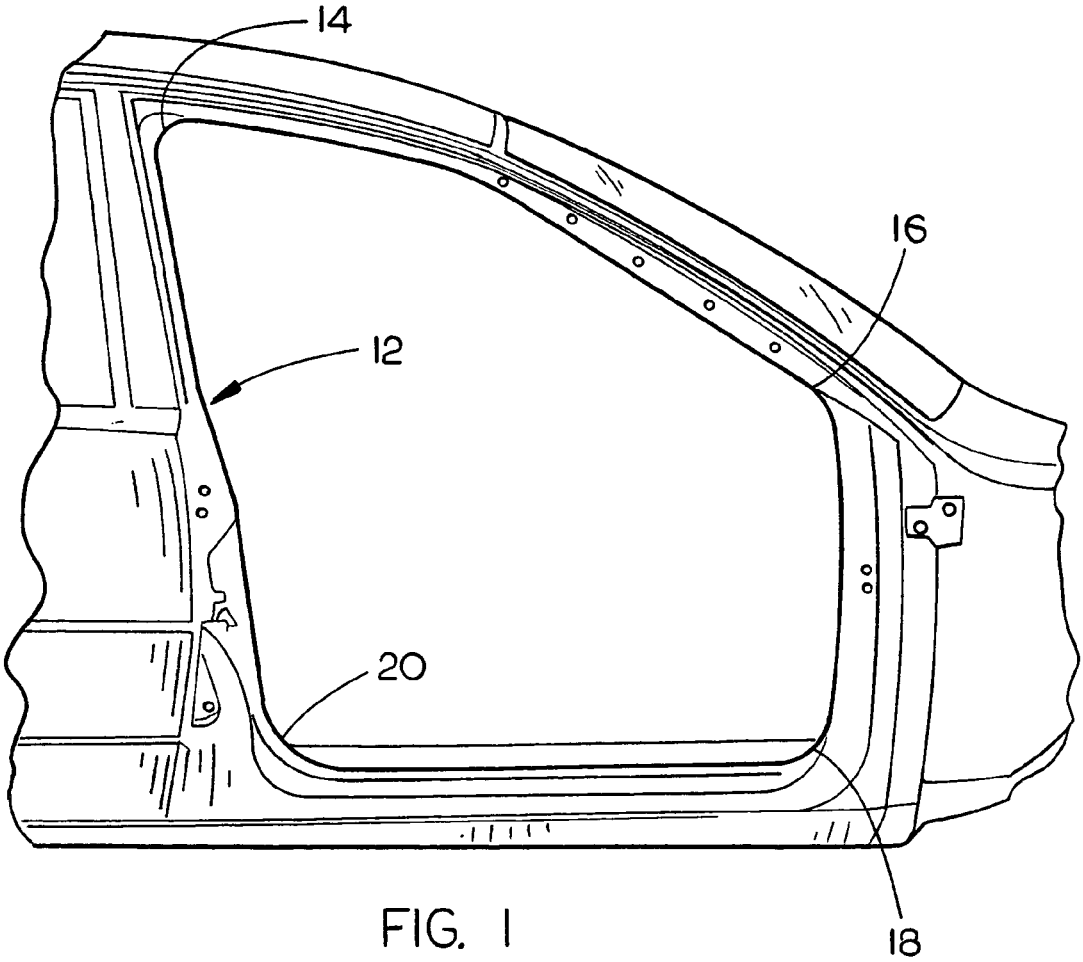
FIG. 1 is a side view of a door frame of a vehicle.
Figure 2:
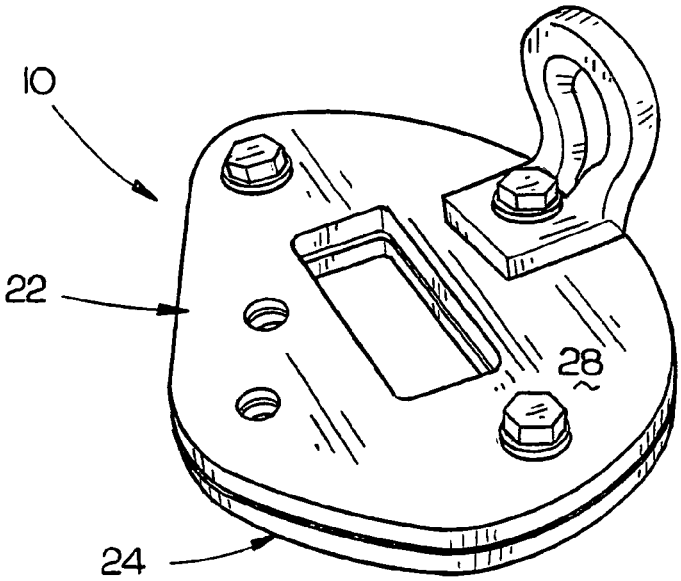
FIG. 2 is a perspective view of the pull clamp of this invention.
Figure 3:
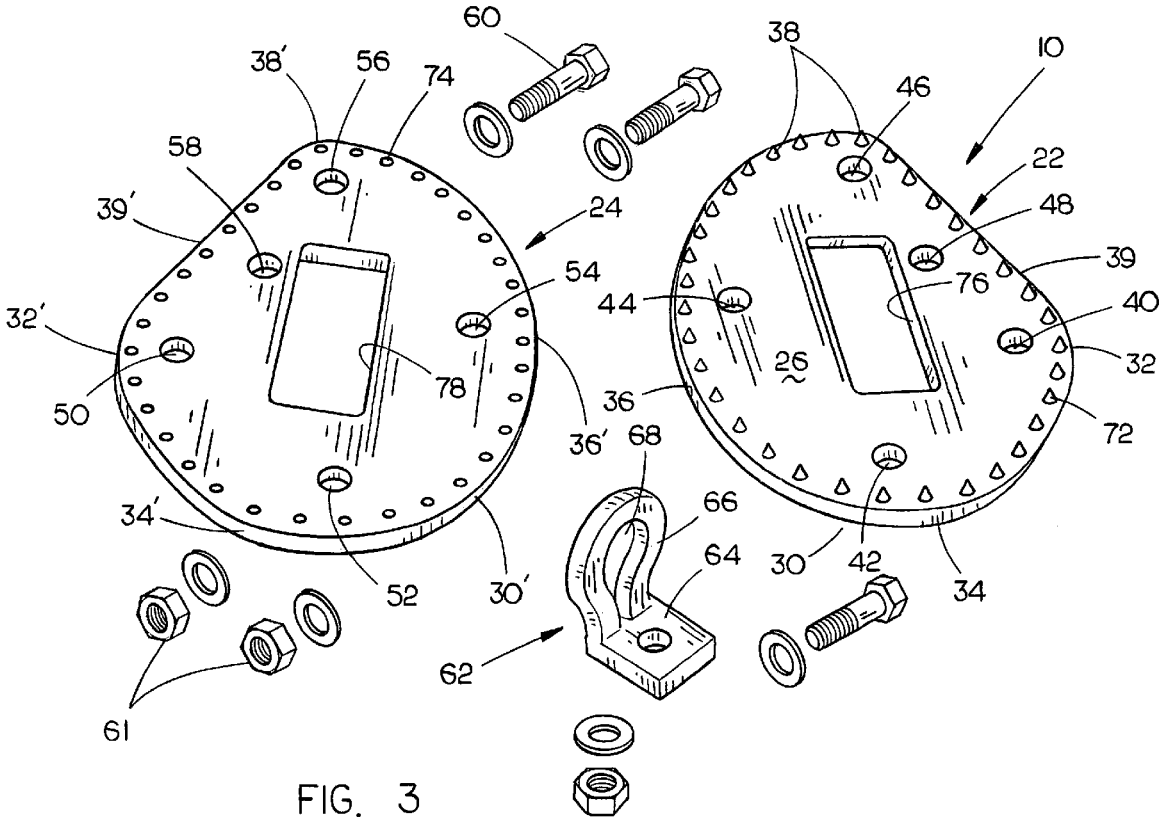
FIG. 3 is an exploded perspective view of the pull clamp of the invention.
Figure 4:
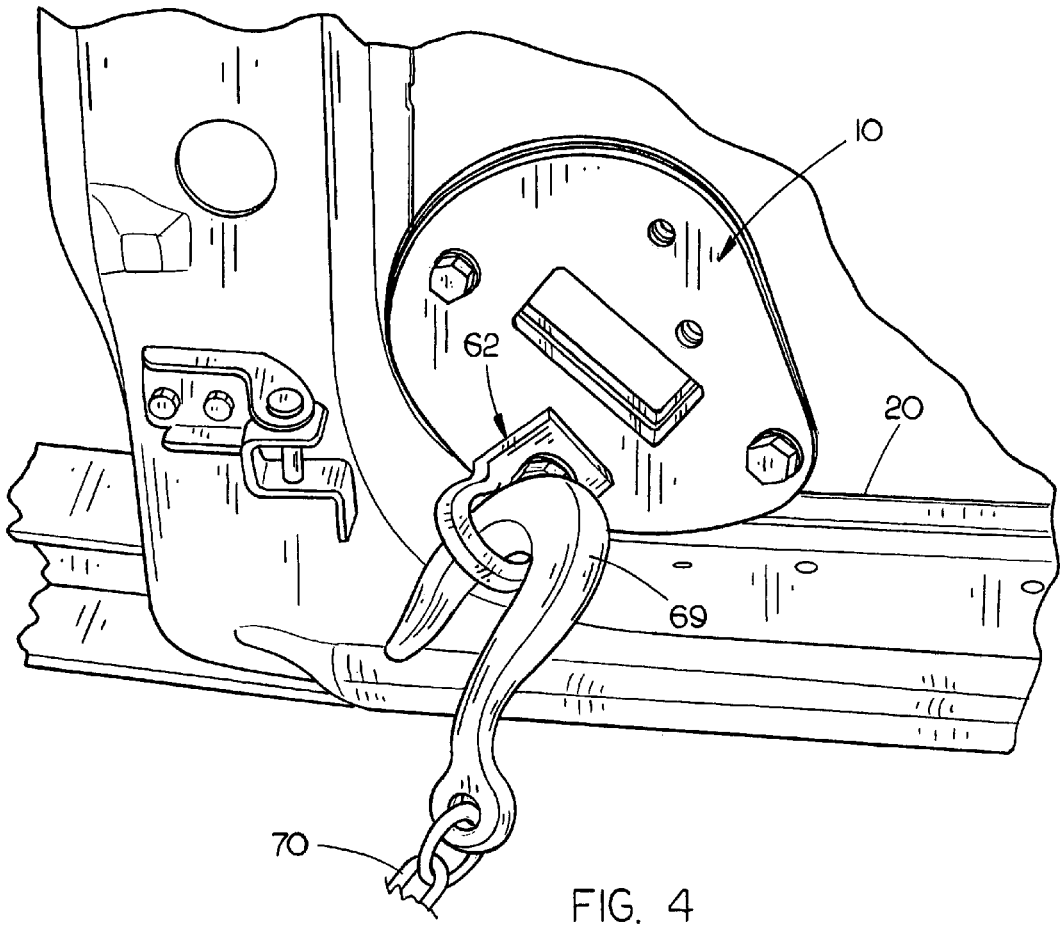
FIG. 4 is a perspective view illustrating the radius pull clamp of this invention being clamped onto a lip of a door frame to enable the door frame to be straightened.

The radius pull clamp of this invention is generally designated by the reference numeral 10 and is designed to assist in the straightening of a vehicle door frame 12 having a plurality of radiused corners or areas 14, 16, 18 and 20, each of which normally have different radiuses. Normally, the frame 12 includes an inwardly protruding lip 20 which may be formed of one or more metal sheets positioned adjacent one another.

If the vehicle door frame 12 is damaged during a wreck, the door frame 12 must be straightened. However, heretofore, there has not been any convenient device for gripping any of the radiuses 14, 16, 18 and 20 to allow a pull chain of a vehicle frame straightening device or the like to pull the door frame back into proper alignment.

Accordingly, applicant has invented the radius pull clamp 10 to permit a pull chain to straighten a damaged door frame. Clamp 10 is comprised of flat clamp plates 22 and 24 which are mirror images of one another. Plate 22 includes an inner side 26, an outer side 28 and a periphery 30. Plate 24 includes an inner side 27, an outer side 29 and a periphery 30'. Periphery 30 includes a plurality of radiuses formed therein. Although it is preferred that radiuses 32, 34, 36 and 38 be provided, more or less radiuses may be employed. Further, it is preferred that periphery 30 be provided with a straight peripheral portion 39, but the same may be omitted if desired.

Bolt openings 40, 42, 44, 46 and 48 are formed in plate 22 while registering bolt openings 50, 52, 54, 56 and 58 are provided in plate 24. As seen, the bolt openings formed in the plates 22 and 24 are in the approximate middle of the radiuses and the straight peripheral portion 22. Bolts 60 are adapted to extend through at least some of the registering bolt openings and maintained therein by nuts 61. The periphery 30' of plate 24 has radiuses 32', 34', 36', 38' and straight peripheral portion 39', the same being identical to the radiuses and straight peripheral portion on plate 22.

The numeral 62 refers to a pull bracket including a base portion 64 and a leg portion 66 which has an opening 68 formed therein adapted to receive the hook 69 of a pull chain 70 of the frame straightening apparatus. The bracket 62 is secured to the clamp 10 by a bolt 60 extending through the registering bolt openings adjacent the radius to be secured to the lip 20. The pull bracket 62 is secured to the clamp 10 adjacent the peripheral radius portion or straight peripheral portion being used.

Figure 5:
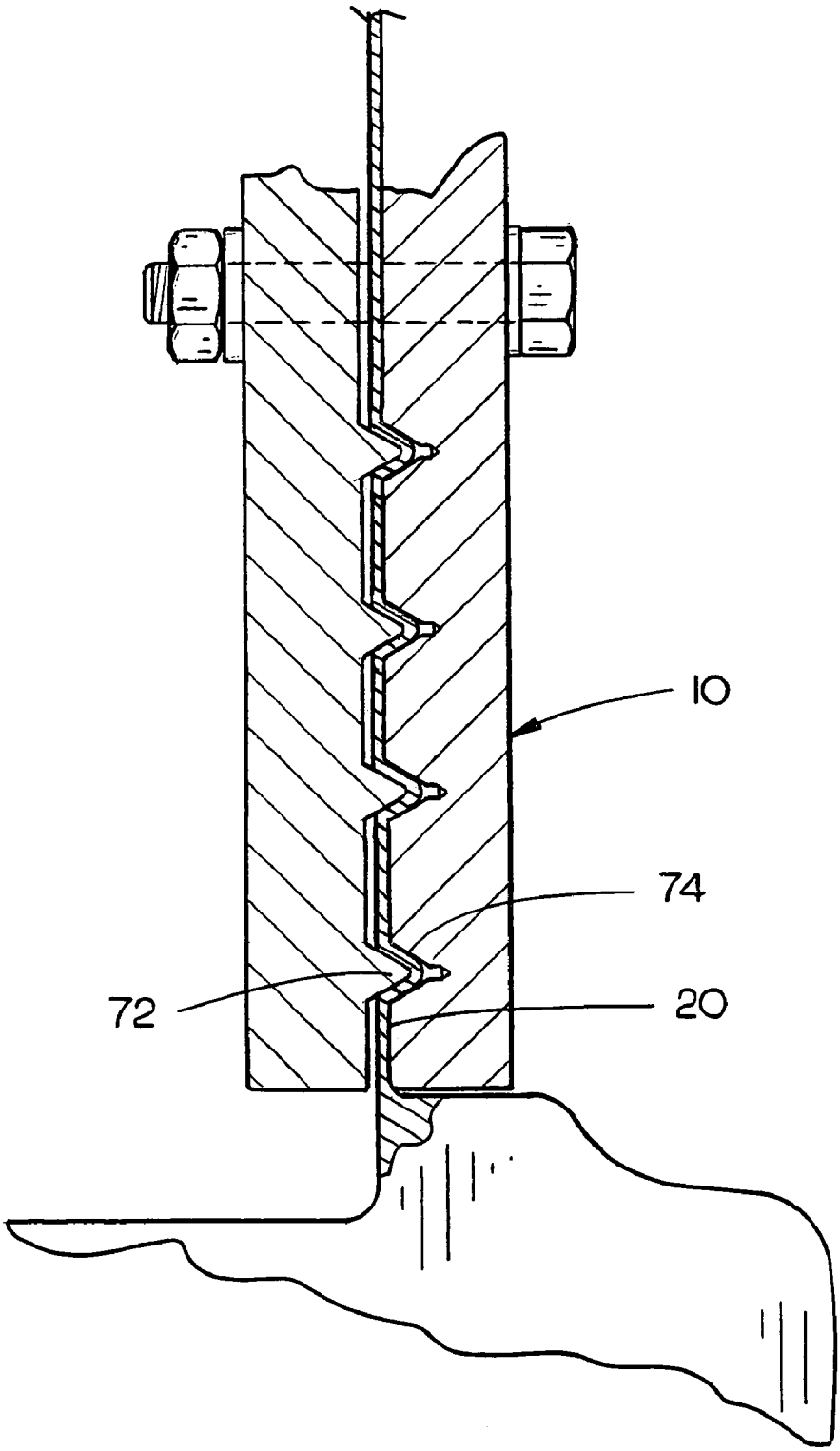
FIG. 5 is a sectional view illustrating the clamp of this invention clamped onto the lip of the door frame.
Figure 6:
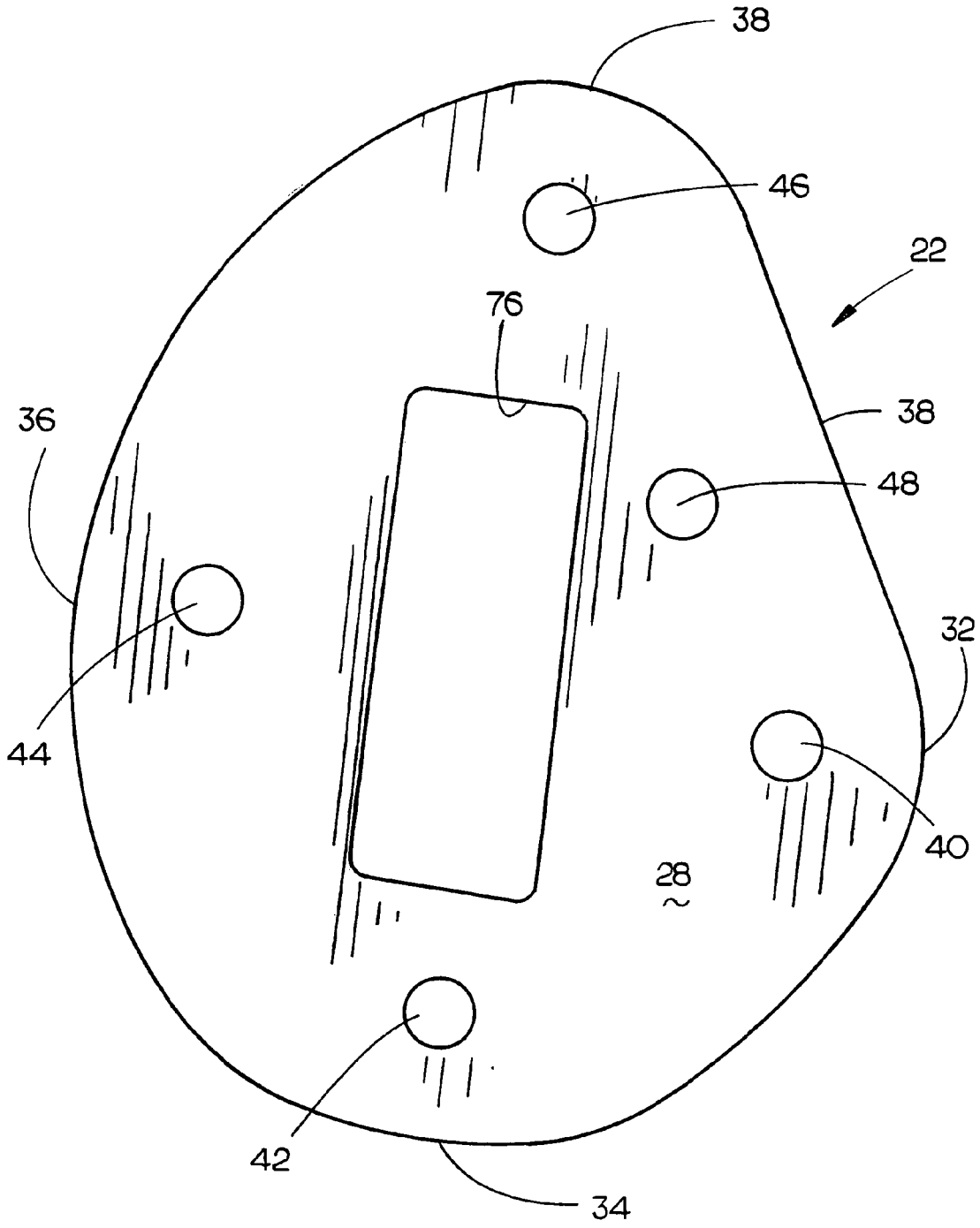
FIG. 6 is a plan view of one of the pull clamp plates.

The inner side 26 of plate 22 has a plurality of heat-treated teeth 72 extending therefrom adjacent the periphery of the clamp plate 22, as seen in the drawings. The inner side 27 of clamp plate 24 has a plurality of recesses or pockets 74 formed therein adjacent the periphery thereof which register with the teeth 72. When the clamp 22 is clamped onto the lip 20, the teeth 72 grip the lip 20 and deform the lip, as seen in FIG. 5, so that the lip 20 is partially forced into the pocket 74. Although the teeth 72 and pockets 74 are preferred, it is possible that the clamp plate will also function without the teeth and pockets. The plates 22 and 24 are provided with handhold openings 76 and 78, respectively, to facilitate the handling of the radius pull clamp of this invention. In use, the pull clamp 10 is manipulated with respect to the door frame 12 to place the proper radius of the clamp 10 in the desired area of the door frame 12 which was heretofore impossible. The straight peripheral portions 39 and 39' may be positioned on either side of straight portions of door frame 12 to facilitate the straightening thereof.

Thus it can be seen that the invention accomplishes at least all of its stated objectives.

I claim:

1. A radius pull clamp for use in pulling vehicle door frames to straighten the same, the clamp comprising:

a first flat clamp plate having inner and outer sides and a periphery;

a second flat clamp plate having inner and outer sides and a periphery;

said first and second clamp plates being mirror images of one another and adapted to be closely positioned together in a superposed relationship;

each of said clamp plates having a plurality of different arcuate radiuses formed in the peripheries thereof;

each of said clamp plates having spaced-apart bolt openings formed therein which register with the bolt openings in the other plate;

bolt members extending through at least some of said registering bolt openings;

a pull bracket secured to the pull clamp by means of one of the bolt members extending through registering bolt openings and said pull bracket.

2. The radius pull clamp of claim 1 wherein each of said clamp plates also has registering straight peripheral portions.

3. The radius pull clamp of claim 1 wherein each of said pull clamps has at least four different arcuate radiuses.

4. The radius pull clamp of claim 1 wherein said bolt openings are formed in said clamp plates adjacent said arcuate radiuses.

5. The radius pull clamp of claim 1 wherein said clamp plates have registering handhold openings formed therein.

6. The radius pull clamp of claim 1 wherein said inner side of said first clamp plate has a plurality of spaced-apart teeth formed therein inwardly of the periphery thereof which extends towards said second clamp plate; said inner side of said second clamp plate having a plurality of spaced-apart recesses formed therein inwardly of the periphery thereof which register with said teeth on said first clamp plate.

7. The radius pull clamp of claim 2 wherein bolt openings are formed in said clamp plates adjacent said arcuate radiuses and said registering straight peripheral portions.

* * * * *